United States Patent [19]

Merkel et al.

[11] 4,121,759

[45] Oct. 24, 1978

[54] PAVEMENT SYSTEM CALCULATOR

[75] Inventors: Richard T. Merkel; William R. Markin, both of Toledo, Ohio

[73] Assignee: Nicholson Concrete Company, Toledo, Ohio

[21] Appl. No.: 754,419

[22] Filed: Dec. 27, 1976

[51] Int. Cl.[2] ..... G06G 1/02

[52] U.S. Cl. ..... 235/70 A; 235/85 R

[58] Field of Search ..... 235/70 A, 70 R, 84, 235/85 R, 89 R, 88

[56] References Cited

U.S. PATENT DOCUMENTS

| | | | |
|---|---|---|---|
| 1,520,105 | 12/1924 | Bicknell | 235/70 A |
| 3,533,551 | 10/1970 | Cole et al. | 235/89 R |
| 3,627,199 | 12/1971 | Hill | 235/85 R |
| 3,814,308 | 6/1974 | Kolan | 235/70 A |
| 3,933,305 | 1/1976 | Murphy | 235/70 A |

*Primary Examiner*—Stephen J. Tomsky

*Attorney, Agent, or Firm*—Barnes, Kisselle, Raisch & Choate

[57] ABSTRACT

A calculator for determining optimum pavement design comprising a pair of slidable members and a plurality of scales associated therewith for determining the Design Traffic Number, Structural Number, depth requirements and costs.

5 Claims, 12 Drawing Figures

DTN

DTN

PAVEMENT SYSTEM CALCULATOR

This invention relates to determining the proper pavement design.

BACKGROUND OF THE INVENTION

At one time, pavement design seemed to be a fairly simple process. Materials and prices were fairly stable, and many engineers and other people in the business could often tell at a glance what structure was best for any particular application.

Today, a host of external factors have combined to make pavement engineering considerably more complex. The specifier today must take into account such diverse considerations as material availability and optimum utilization of scarce natural resources. With the rapidly increasing costs of asphalt, labor and other components, it is becoming critically important that each pavement project be carefully engineered not only for adequate strength and sufficient durability, but for a minimum cost and optimum value as well.

The basic procedures and formulas needed to make these decisions are reasonably well established and are commonly accepted. But until now, they have required long and tedious calculations, using charts, graphs and a good deal of trial and error. A simpler procedure is needed.

The present invention was designed to meet this need. It provides a simple, practical way to (1) determine the structural requirements of a particular application, according to traffic and soil conditions, (2) determine the various alternative combinations of surface, base and sub-base that will meet these structural requirements, and (3) compare the real cost of these alternatives in terms of cost/square yard at current materials prices, to find the most economical combination for these structural requirements. Most important, the invention comprises a simple, easy to use calculator that enables the user to make these determinations quickly, accurately and efficiently.

Pavement design is still largely an art, and requires a considerable degree of engineering judgment.

At the same time, however, there is a body of commonly accepted formulas and relationships that may be used to estimate the proper thickness of pavement for any given application, and these are incorporated in this system. They are reasonably valid for typical situations and can be adjusted to fit unusual conditions. In order to make sound judgments, a design still requires a knowledge of pavement behavior and characteristics.

The flexible pavement engineering system of this invention is a tool to assist the engineer in making these judgments. Used in this manner, it will provide a basis for making comparisons using current prices to find the one structural alternative that offers the optimum combination of performance and cost.

The system follows standard engineering procedure. Its strength is in its simplicity and its ability to quickly and easily give answers to complex computations.

Initially, a determination is made of the proper structural design coefficient for a particular application expressed in terms of an SN number. This in turn requires a reasonable prediction of the traffic load that the pavement will be subjected to, expressed as a Design Traffic Number (DTN), and also the properties of the soil on which the pavement is to be constructed, expressed as a CBR (California Bearing Ratio) number.

The calculator provides a simple way of determining the former.

From these two numerical values, the calculator will directly compute the Structural Number, or SN, for the particular application. It will then provide various alternative material combinations that will yield this SN and assist in determining the actual cost per square yard of each of these alternatives.

DESCRIPTION

Figure 1:
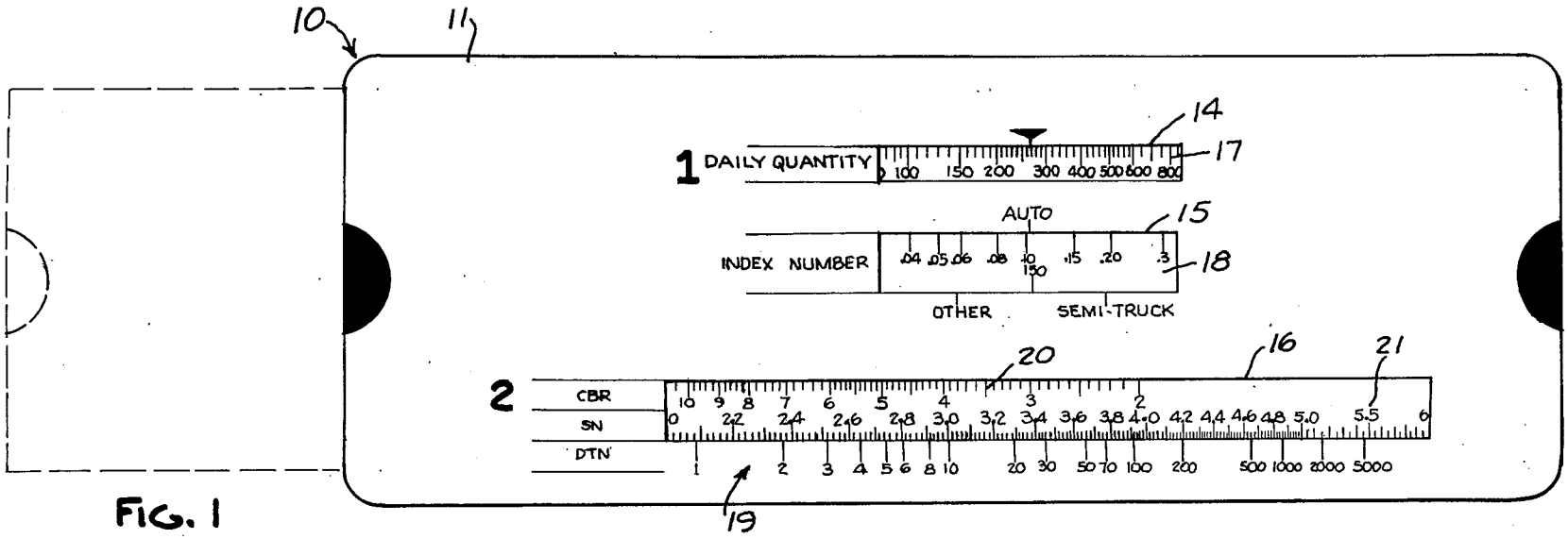
FIG. 1 is a view of a calculator utilized in the system.
Figure 2:
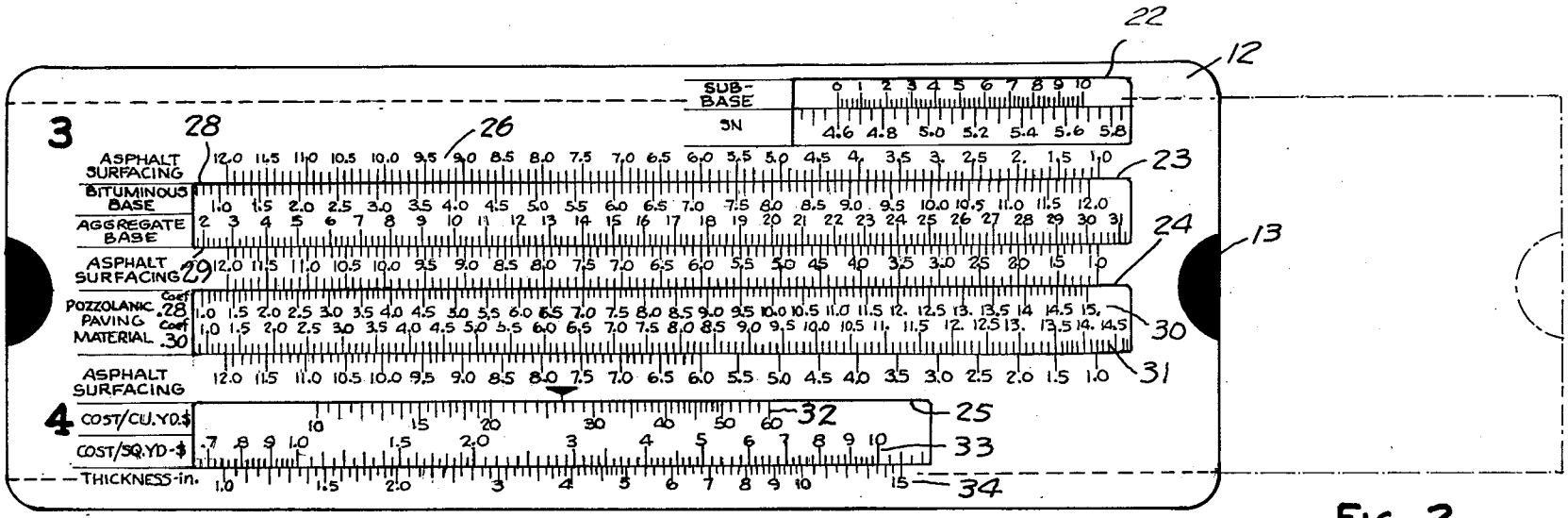
FIG. 2 is a rear view of the calculator.

The flexible pavement engineering system embodying the invention includes the utilization of a calculator such as shown in FIGS. 1 and 2 to determine the Design Traffic Number (DTN), the Structural Number (SN), the alternative materials which can be used, and the relative costs thereof.

Basically, calculator 10 is of the slide calculator type and includes a front wall 11 and a back 12 with a slide 13 slidable between the front and back walls 11, 12. Calculator walls 11, 12 and slide 13 may conveniently be made of cardboard.

The front wall 11 includes a first elongated slot 14, a second elongated slot 15, and a third elongated slot 16. The reference numeral 1 is provided adjacent the slots 14, 15 as well as the words "Daily Quantity" adjacent slot 14 and "Index Number" adjacent slot 15. The slide 13 includes a scale 17 partially visible through the slot 14 with indicia corresponding to numbers of cars. The slide 13 further includes indicia 18 corresponding to index numbers, as presently defined, in association with slot 15. The outer wall 11 further includes an index designated AUTO adjacent slot 15 and additional indexes designated OTHER and SEMI-TRUCK adjacent slot 15.

The outer wall 11 includes the designation or indicia CBR and SN at one end of slot 16 with the indicia DTN and a scale 19 extending along the lower edge of slot 16. Indicia corresponding to CBR is provided on the slide 13 as at 20 and indicia corresponding to SN is provided on the slide 13 adjacent the index SN as at 21.

The rear wall 12 of the calculator 10 is provided with a short elongated slot 22, additional slots 23, 24, 25. The wall 12 is provided with a large reference numeral 3 adjacent slot 23 and large reference numeral 4 adjacent slot 25. Rear wall 12 is provided with indicia designated ASPHALT SURFACING and corresponding scale 26 along the upper edge of slot 23; indicia BITUMINOUS BASE and ASPHALT SURFACING on the wall 12 adjacent one end of slot 23; additional scale 27 along the lower edge of slot 23 and upper edge of slot 24 identical to indicia 26. The slide 13 is provided with associated scales 28, 29 aligned with the designations BITUMINOUS BASE and ASPHALT SURFACING.

Similarly, slot 24 is provided with designations POZZOLANIC PAVING MATERIAL at one end thereof. Slot 25 is provided with indicia COST/CU YD and COST/SQ YD and THICKNESS inches. An associated scale 34 is provided along the lower edge of slot 25 adjacent THICKNESS inches. Slide 13 is provided with scales 30, 31, 32, 33, associated with the headings BITUMINOUS BASE, ASPHALT SURFACING,

POZZOLANIC PAVING MATERIAL, COST/CU YD, COST/SQ YD.

The first step in making a pavement determination is the determination of the Structural Number, or SN. The SN is an abstract numerical value expressing the structural strength of the pavement required for a given combination of soil support value, total accumulated axle loads, and other considerations.

Two main factors affect the structural strength required in various pavement applications. The first of these is the traffic load that the pavement must carry, expressed in terms of a Design Traffic Number (DTN). The second is the sub-grade support, expressed as the California Bearing Ratio (CBR) number.

The Design Traffic Number (DTN) is a numeral representing the accumulated traffic loads that the pavement is expected to carry. Since higher axle loads do relatively greater damage to pavement, the calculations are balanced so that heavier vehicles, with higher axle loads, contribute proportionately larger increments to the DTN than lighter vehicles.

For present purposes, all vehicles are divided into three categories: automobiles; semi-trucks; and other vehicles, such as buses, vans, stake trucks, etc. Of the three classes of vehicles, semi-trucks make the greatest contribution to DTN, because even though their numbers may be relatively small, the wear to which they subject pavement is often the critical factor in determining structural requirements. The other vehicles classification makes a smaller contribution, and automobiles a very small amount.

To calculate DTN, the averge daily traffic during the design period in each of these classifications is required. These values may be estimated in some reasonable way or projected from actual current traffic counts.

In the past, once these numbers were available, it was necessary to use numerical coefficients for each and calculate the DTN. The calculations are done by use of the calculator and it is only necessary to add the DTN index number of each of these together to obtain the DTN.

The DTN is calculated on the first side of the calculator. The daily quantity of each of the three vehicles is set at the arrow and the DTN index number is read at the appropriate spot on the scale below.

Figure 3:
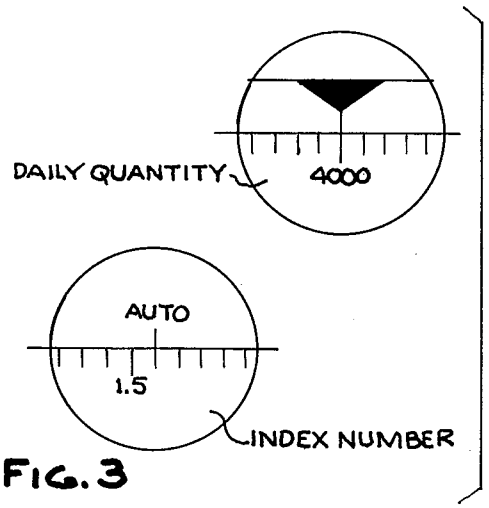
FIGS. 3–12 are partly diagrammatic views showing the manner in which the calculator is used in the system.

For example, to determine the DTN for a road carrying an average of 4,000 automobiles, 300 semi-trucks, and 200 other vehicles daily in the design lane, begin by setting the daily quantity at 4,000, and reading the DTN index at the AUTO indicator below. The answer is 1.6 (FIG. 3)

Figure 4:
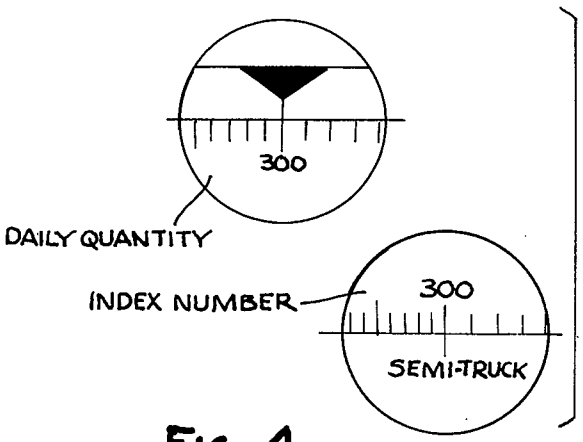
Figure 5:
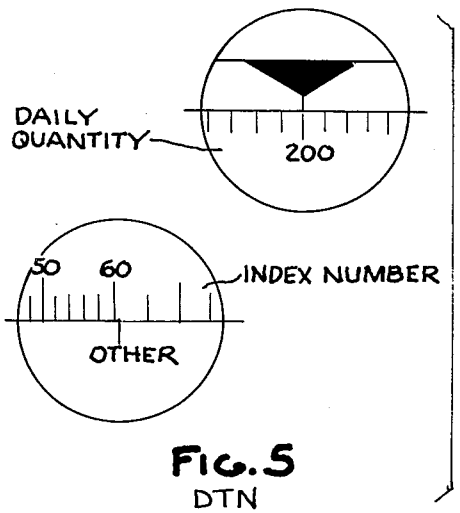

The daily quantity indicator is then set at 300 and the answer (300) is read at the SEMI TRUCK indicator (FIG. 4). The daily quantity is set at 200 and the DTN index of approximately 63 is read for OTHER vehicles (FIG. 5).

Thus, the DTN is 364.6 (1.6 + 300 + 63) or approximately 365. This calculation can be summarized as follows:

| | | | |
|---|---|---|---|
| Daily auto traffic | 4,000 | Index number | 1.6 |
| Daily semi traffic | 300 | Index number | 300 |
| Daily other traffic | 200 | Index number | 63 |
| DTN (total of all three index numbers) | | | 364.6 |

The California Bearing Ratio (CBR) is a numerical representation of the subgrade support, and is the result of sampling and testing by a soils testing laboratory. Some typical CBR values are listed below.

TYPICAL CBR VALVES

| CBR | Soil Description |
|---|---|
| 2 and below | Unsuitable-replace or stabilize |
| 3 | Predominant Toledo soil, wet silty clay |
| 2 to 4 | Moist silty clay |
| 4 to 6 | Sandy silt, silty clay |
| 6 to 8 | Dry sandy silt, sandy loam |
| 8 to 10 | Clay gravels, firm sands |

Figure 6:
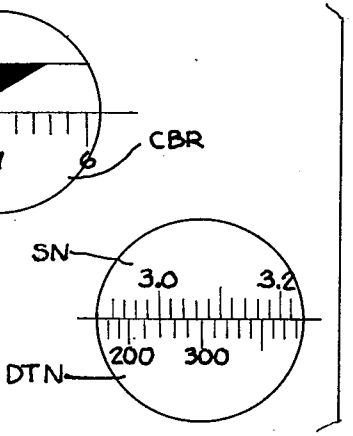

With the DTN and the CBR values, the SN can be determined directly on the bottom portion of the first side of the calculator. The CBR is set under the arrow on the top scale, the DTN is located on the bottom scale. The SN appears directly above the proper DTN on the SN scale (FIG. 6).

In the example above, with a CBR of 7, the slide is set so the 7 is directly under the arrow. Then, locating the DTN of 365 on the bottom scale, the SN of 3.15 is read directly above it.

Summarizing, place the CBR 7 at the arrow on the top scale, and find the DTN 365 on the bottom scale. Then read the SN 3.15 directly above the DTN.

Once the required SN is determined, the next step is to determine the various alternative materials and combinations of materials that will yield the desired SN.

This is done on the top portion of the second side of the calculator, and considers three different possible combinations: an asphalt surface with bituminous, aggregate or Poz-O-Pac bases. Poz-O-Pac is a trademark for line-fly ash-aggregate bases.

The first step is setting the calculator. In some cases, a sub-base is required in specifications and this consideration is included at this point.

Figure 7:
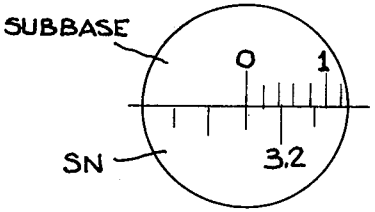

To set the materials calculator, the required SN is aligned under the index for the sub-base to be used in the upper right hand corner. If no sub-base is being used, the SN is set under the zero on the sub-base scale. In the example, with an SN of 3.15, it is assumed that no sub-base is called for. The calculator is set by aligning the SN of 3.15 under the zero on the sub-base scale (FIG. 7).

With this basic setting, there are virtually unlimited combinations of asphalt surface and base materials that will yield the desired SN.

With the increased cost of asphalt and the growing shortage of petroleum products, however, it is difficult to justify — both from the standpoint of energy conservation and for economic reasons — the use of any more asphalt than absolutely necessary to yield the necessary strength and wearing surface characteristics. Therefore, the present invention is based upon the assumption that only the minimum amount of asphalt wearing surface should be used.

The thickness of asphaltic concrete required for a proper wearing surface is a function of the kind of traffic it must bear, and the base material used beneath it. Since both Poz-O-Pac base and bituminous bases are stabilized, they require a lesser thickness of asphalt for a surface than would an aggregate base.

For example, recommended asphalt surface thickness requirements for various applications and bases are shown on the chart below.

ASPHALT SURFACE DEPTH REQUIREMENTS

| Application | Poz-O-Pac Base | Bituminous Base | Aggregate Base |
|---|---|---|---|
| Heavy duty - SN of 4 and above (truck terminals, major thoroughfares, etc.) | 3" | 3" | 5" |
| Medium duty - SN of 2.5 – 3.0 (residential streets, commercial drives, etc.) | 2" | 2" | 4" |
| Auto parking - SN of 2 | 1½" | 1½" | 2½" |

From this information, three basic alternatives can be developed with the appropriate asphalt surface and base material thicknesses.

To find the asphalt-base material alternatives, the thickness of the asphalt wearing surface (from chart above) is located and the thickness of each base material is read on the scale at that point.

Figure 8:
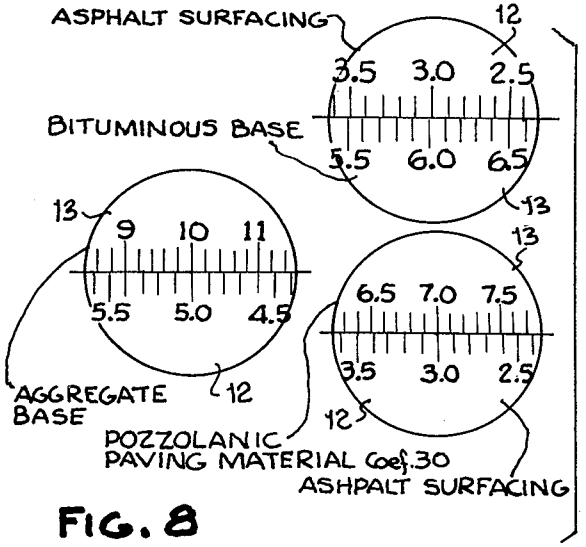

If the example is for a major thoroughfare requiring a heavy-duty surface, 3" of asphalt and 6" of bituminous base; or 3" of asphalt and 7" of Poz-O-Pac base; or 5" of asphalt and 10" of aggregate base are required (FIG. 8).

Thus, this determination is summarized as follows:

| Sub-base required 0" | Bituminous | Aggregate | Poz-O-Pac |
|---|---|---|---|
| Asphalt Surface | 3" | 5" | 3" |
| Base Thickness | 6" | 10" | 7" |

There are thus three alternatives (an appropriate asphalt surface with either a bituminous, a compacted aggregate or Poz-O-Pac base) which will meet the requirements of our specifications.

The final step is to compute the actual cost per square yard of each of these to find the most economical solution to our needs. This is done on the bottom portion of the second side of the calculator.

The current cost/cubic yard of a material is set at the arrow on the top scale. Then the thickness required is found on the bottom scale. The cost/square yard of the material is read on the center scale directly above the thickness required.

Figure 9:
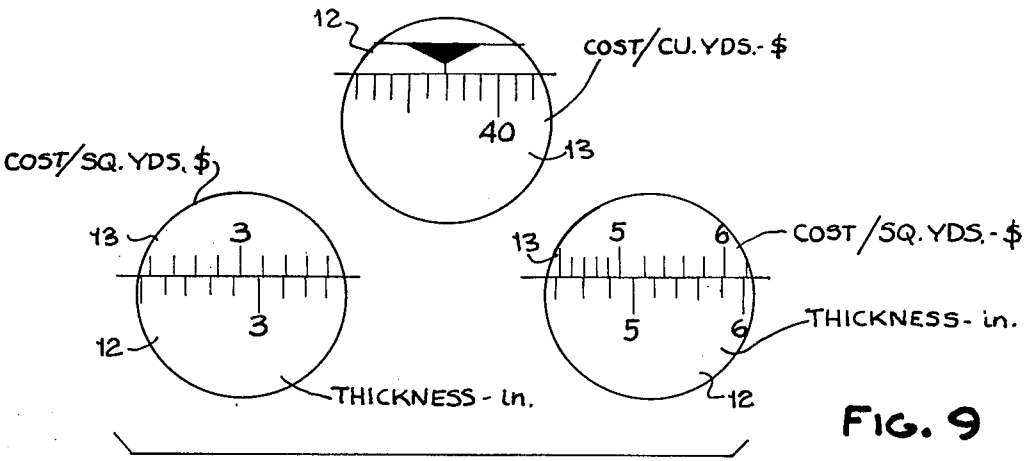
Figure 10:
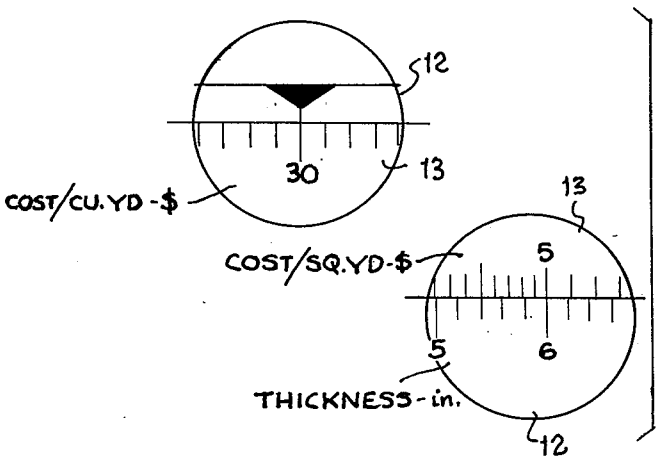
Figure 11:
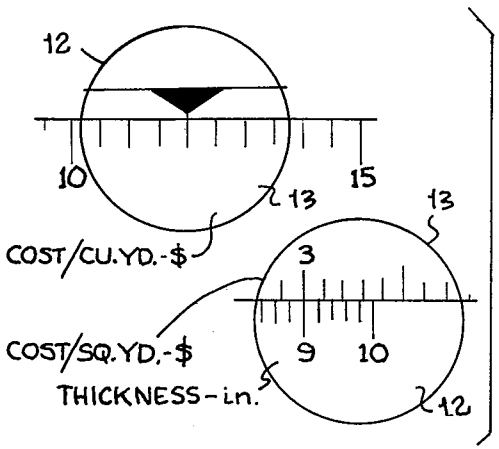
Figure 12:
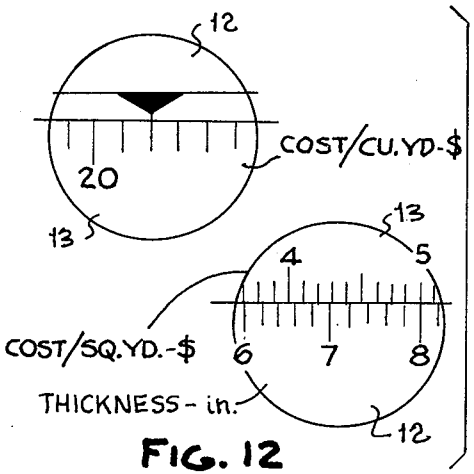

Using the example, assuming the following prices per cubic yard are current: asphalt surfacing, $37.00; bituminous base, $30.00; aggregate base, $12.00; and Poz-O-Pac base, $22.00. The current price of asphalt $37.00 is set under the arrow. Then, by reading the cost above the desired thickness, it is found that 3" of asphalt surfacing will cost $3.10/sq. yd.; and 5" will cost $5.20/sq. yd. (FIG. 9). Then the cost calculator is set for $30/cu. yd., the price of bituminous base, and it is found that 6" will cost $5.00/sq. yd. (FIG. 10). 10" of aggregate base at $12.00/cu. yd., will cost $3.35/sq. yd. (FIG. 11). Finally, the required 7" of Poz-O-Pac base at $22/cu. yd., will cost $4.30/sq. yd. (FIG. 12).

Adding all of the alternative costs together, the following comparative costs are found:

| | Bituminous Base | Aggregate Stone Base | Poz-O-Pac Base |
|---|---|---|---|
| Sub-base | $0/sq. yd. | $0/sq. yd. | $0/sq. yd. |
| Surface | $3.10/sq. yd. | $5.20/sq. yd. | $3.10/sq. yd. |
| Base Material | $5.00/sq. yd. | $3.35/sq. yd. | $4.30/sq. yd. |
| Total Cost/Sq. Yd. | $8.10 | $8.55 | $7.40 |

Thus in the example, the combination of 3" of asphalt surface and 7" of Poz-O-Pac has the lowest cost. Since each of the alternatives has been designed to the same SN requirements, the asphalt-Poz-O-Pac combination is therefore the optimum selection for this pavement.

It can thus be seen that there has been provided a calculator that can be used to quickly and effectively determine the proper pavement materials and costs thereof.

The calculator incorporates in part 1 scales based upon data that has been developed by recognized authorities, e.g., the appropriate state authorities. By way of example, such data is available in the Ohio Department of Transportation Design Policy Memorandum dated Feb. 1, 1975. Similarly, data for part 2 has been established in publications, such as The Asphalt Institute Manual Series No. 1 (MS-1), August 1970. The data for part 3 has also been established by various governmental authorities, by way of example, the aforementioned Ohio Department of Transportation Design Policy Memorandum dated Feb. 1, 1975.

We claim:

1. A pavement system calculator for use in determining optimum pavement design by determining a structural design coefficient for a particular application expressed as an SN number utilizing a reasonable prediction of the traffic load that the pavement will be subjected to per unit time expressed as Design Traffic Number (DTN) and the properties of the soil on which the pavement is constructed expressed as a California Bearing Number (CBR) comprising a fixed member, a slide member associated for movement with respect to said fixed member, a first scale on said slide member having indicia corresponding to quantity of vehicles moving along the pavement per unit time (DTN), a first index on said fixed member associated with said first scale, a second scale and a third scale on said slide member including indicia corresponding to the DTN, and second and third indexes on said fixed member associated with said last-mentioned second and third scales and corresponding to the type of vehicle, a fourth index on said fixed member, a fourth scale on said slide member associated with said fourth index and having indicia corresponding to CBR, a fifth scale on said slide member associated with said fourth index and having indicia corresponding to SN, and a sixth scale on said fixed member corresponding to DTN and associated with said fourth and fifth scales, said first scale on said slide member and said second and third scales on said slide member being interrelated and positioned such that the DTN number can be determined by moving the slide member to bring the scale reading for the daily quantity of vehicles adjacent the first index and reading the index number on the second scale at one of the second or third indexes adjacent the second and third scales, said fourth and fifth scales being interrelated and positioned such that the SN number can be determined by moving the slide member to set the CBR number at the fourth index, locating the previously determined DTN number on the sixth scale and reading the SN number on the slide member.

2. The pavement system calculator set forth in claim 1 including a seventh scale on said fixed member including indicia corresponding to the thickness of a sub-base, an eighth scale on said slide member associated with said seventh scale and having indicia corresponding to the SN number, said fixed member having a ninth scale thereon corresponding to the thickness of one type of paving material, said slide member having additional scales thereon associated with said last-mentioned scale corresponding to the thickness of additional materials, said eighth scale on said slide member and said ninth and additional thickness scales being interrelated and positioned such that when the slide member is moved to bring the SN number previously determined adjacent the thickness of the sub-base on the seventh scale, the interrelationship of thicknesses of various materials can be read on the ninth and additional scales.

3. The pavement system calculator set forth in claim 2 wherein said fixed member has a fifth index thereon and a scale associated with said index corresponding to thickness of materials, said slide member having cost per cubic yard and cost per square yard scales thereon associated with the fifth index and the associated scale and corresponding to the cost of the materials, said cost scales on said slide member being interrelated and positioned so that the cost of material can be determined by moving the slide member to bring the cost per cubic yard adjacent the fifth index, locating the thickness required on the thickness scale associated with the fifth index and reading the cost per square yard on the slide member above the thickness required.

4. The pavement system calculator set forth in claim 3 wherein the pavement calculator has a front wall and a rear wall, said front wall has first, second and third slots therein, said first index being associated with said first slot and said first scale being visible through said first slot, said second and third indexes being associated with said second slot and said second and third scales being visible through said second slot, said fourth index and said sixth scale being associated with said third slot and said fourth and fifth scales being visible through said third slot.

5. The pavement system calculator set forth in claim 4 wherein said rear wall has fourth, fifth and sixth slots therein, said seventh scale being associated with said fourth slot and said eighth scale being visible through said fourth slot, said ninth scale being associated with said fifth slot and said additional scales being visible through said fifth slot, said fifth index and thickness scale being associated with said sixth slot and said cost per cubic yard and cost per square yard scales being visible through said sixth slot.

* * * * *